United States Patent [19]

Drews et al.

[11] Patent Number: 5,076,435

[45] Date of Patent: Dec. 31, 1991

[54] PACKAGING FOR FOOD

[75] Inventors: Kurt H. Drews, Aachen; Werner Hünninghaus, Cologne, both of Fed. Rep. of Germany

[73] Assignee: Ludwig Schokolade GmbH, Aachen, Fed. Rep. of Germany

[21] Appl. No.: 589,162

[22] Filed: Sep. 27, 1990

[30] Foreign Application Priority Data

Oct. 3, 1989 [DE] Fed. Rep. of Germany ..... 3932997

[51] Int. Cl.[5] ..... B65D 81/02; B65D 85/60; B65D 6/02

[52] U.S. Cl. ..... 206/521.1; 206/591; 206/499; 206/564; 426/124; 426/119

[58] Field of Search ..... 206/499, 594, 585, 564, 206/521.1, 591; 426/119, 124

[56] References Cited

U.S. PATENT DOCUMENTS

| | | | |
|---|---|---|---|
| 1,646,147 | 10/1927 | Hoffman | 206/499 |
| 2,452,150 | 10/1948 | Roberts | 206/521.1 |
| 3,482,679 | 12/1969 | Bixler et al. | 229/125.19 |
| 3,768,639 | 10/1973 | Dogliotti | 206/564 |
| 4,517,206 | 5/1985 | Murphy et al. | 426/124 |
| 4,802,619 | 2/1989 | Laido | 229/125.19 |

*Primary Examiner*—Paul T. Sewell
*Assistant Examiner*—M. D. Patterson
*Attorney, Agent, or Firm*—Robert W. Becker & Associates

[57] ABSTRACT

A packaging for food comprises a bottom portion, a lid portion and a product holder for the reception of individual pieces. In order to improve and stabilize the outward appearance of the packaging, the product holder is equipped with a peripheral edge section, which extends past the free rim of the bottom portion and has a slant sloping in the direction of the bottom portion and supports the lid portion. The lid portion is provided with a transition slant, which matches the slope of the slant of the product carrier.

13 Claims, 3 Drawing Sheets

PACKAGING FOR FOOD

BACKGROUND OF THE INVENTION

The present invention relates to a packaging for food, especially for individual pieces of chocolate or candy, comprising a product holder inserted into a bottom portion and a lid portion which seals the bottom portion containing the product holder.

Known packaging of the described kind, for example, candy boxes, consist of a bottom portion, which is open on one side and of a parallelepipedal shape, and a lid portion, which is open on one side, also of a parallelepipedal shape and seals the packaging by overlapping. The bottom portion contains a product holder, respectively a sectioned insert, which is equipped with pockets to hold the candies. The upper free rim of the bottom portion and the packaging level of the product holder are usually in one plane, or, when a padding material is provided, the packaging level of the product holder is below the lane enclosed by the rim of the bottom portion. Such a packaging gains its stability from the bottom and lid portion that overlap, while the product holder is loosely inserted. The product holder often consists of rather thin plastic foils while the individual pieces, for example, candy, are fairly heavy. When the packaging is stored on edge for an extended period of time, the individual pieces may exert deforming forces on the product holder via the pockets, in which they are contained, and may change the position of the product holder in relation to the lid and bottom portion of the packaging. In general, this may only be avoided by introducing inserts made from cardboard, carton, polystyrol etc. between the pockets and/or at the circumference of the product holder, thereby stiffening the product holder. However, this requires more packaging material in addition to the large amount that is already being used for the lid portion. Conventional packaging still has the disadvantage that a pointed impact onto the usually rectangular edges leaves a permanent deformation, which impairs the aesthetical appearance and reduces the value of such a sale unit. It is, of course, known, especially for candy boxes, how to protect the packaging against damage in several better ways, but there is invariably more material and processing involved, as, for example, in reinforcing the bottom and lid portions by additional elements, made from cardboard or carton, or, sometimes, by padding material. Also, the bottom and lid portion are composed of many individual elements and the assembly of the packaging is rather labor intensive.

It is therefore an object of the present invention to improve the appearance of the abovementioned packaging by constructive measures and to maintain said appearance during transport and storage by absorbing impact in an elastic manner without deformation of the edges.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
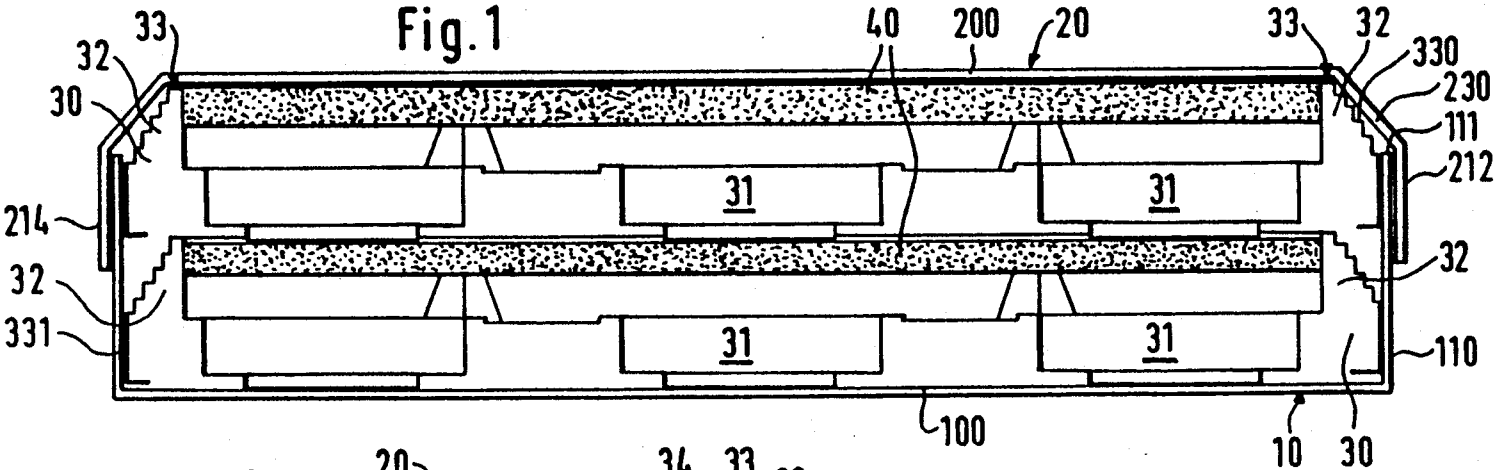
FIG. 1 is a cross-sectional view of a packaging with two product holders.

The packaging for food of the present invention is primarily characterized by a peripheral edge portion of the product holder, which extends past a free rim of the bottom portion, that is slanted downward in the direction of the bottom portion, and supports the lid portion.

The advantage of the packaging according to the present invention is that the bottom portion as well as the lid portion may be cut as a single piece. Additional material may be saved by not having the bottom and the lid portion completely overlap. Also the lid portion is not supported by the bottom portion but rests on the peripheral edge of the product holder, which extends past the upper rim of the bottom portion and the lid portion. The lid portion presses onto the product holder along equally spaced imaginary lines which run inside the walls of the bottom portion parallel to those walls and, via the slants sloping down in the direction of the bottom portion, exercise a slanted pressure component onto the side walls of the bottom portion. However, the side walls of the bottom portion do not break away, because, in the contact area, they are enclosed by the side walls of the lid portion. The lid portion, the product holder, and the bottom portion are in contact in the area of the free rim of the bottom portion, resulting in a mutual stabilizing effect. An impact on the lid portion is mostly absorbed in an elastic manner by the slants and the bottom portion is only mildly affected. Upon opening of the packaging, the slant forms an aesthetical, pleasant frame for the packaging level, since the slant, together with the peripheral edge of the product holder, extends over the rim of the bottom portion. The free peripheral edge of the product holder is narrow and therefore visually pleasant. Without providing additional supporting and stabilizing inserts, the individual pieces, especially candies, are better protected against impact.

The lid portion is advantageously equipped with a transition slant, which may be matched to the slope of the slant of the product holder. The lid portion therefore does not have sharp edges. Impacts during transport or storage are elastically absorbed so that there are no permanent deformations to the lid portion. Consequently, the pleasant appearance of the packaging is not impaired even when it is handled carelessly. The upper edge of the peripheral edge section extends past the plane formed by the round tops of the individual pieces, i.e., the packaging level. Between the packaging level and the plane, which is enclosed by the upper edge of the product holder, supports for a padding insert are arranged, whereby lateral stabilization of the padding insert is provided by the edge section of the product holder. For candy boxes it has been known to provide a padding insert on top of the product holder but, in the prior art, the product holder is completely covered by the padding insert, by extending to the free peripheral rim of the bottom portion. However, the packaging of the present invention is different. The padding insert is partially placed inside the product holder and thereby forms a unit with the product holder. The padding insert rests on the supports in the form of bracket plates, which are arranged in the corners of the product holder, and not on the round tops of the individual pieces. This arrangement allows for the stacking of several such units inside a packaging. The padding insert also serves to stabilize and protect against deformations of the edge section of the product holder directed towards the center. Additional stiffening of the single wall lid portion is thereby achieved, because the padding insert, together with the edge section, stabilizes the edges of the lid portion in an elastic manner.

DESCRIPTION OF PREFERRED EMBODIMENTS

The present invention will now be described in detail with the aid of several specific embodiments utilizing FIG. 1 to 3.

Figure 2:
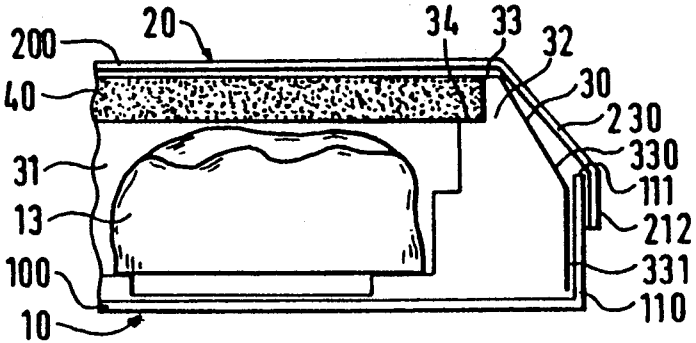
FIG. 2 shows the edge construction of a monolayer packaging.
Figure 3:
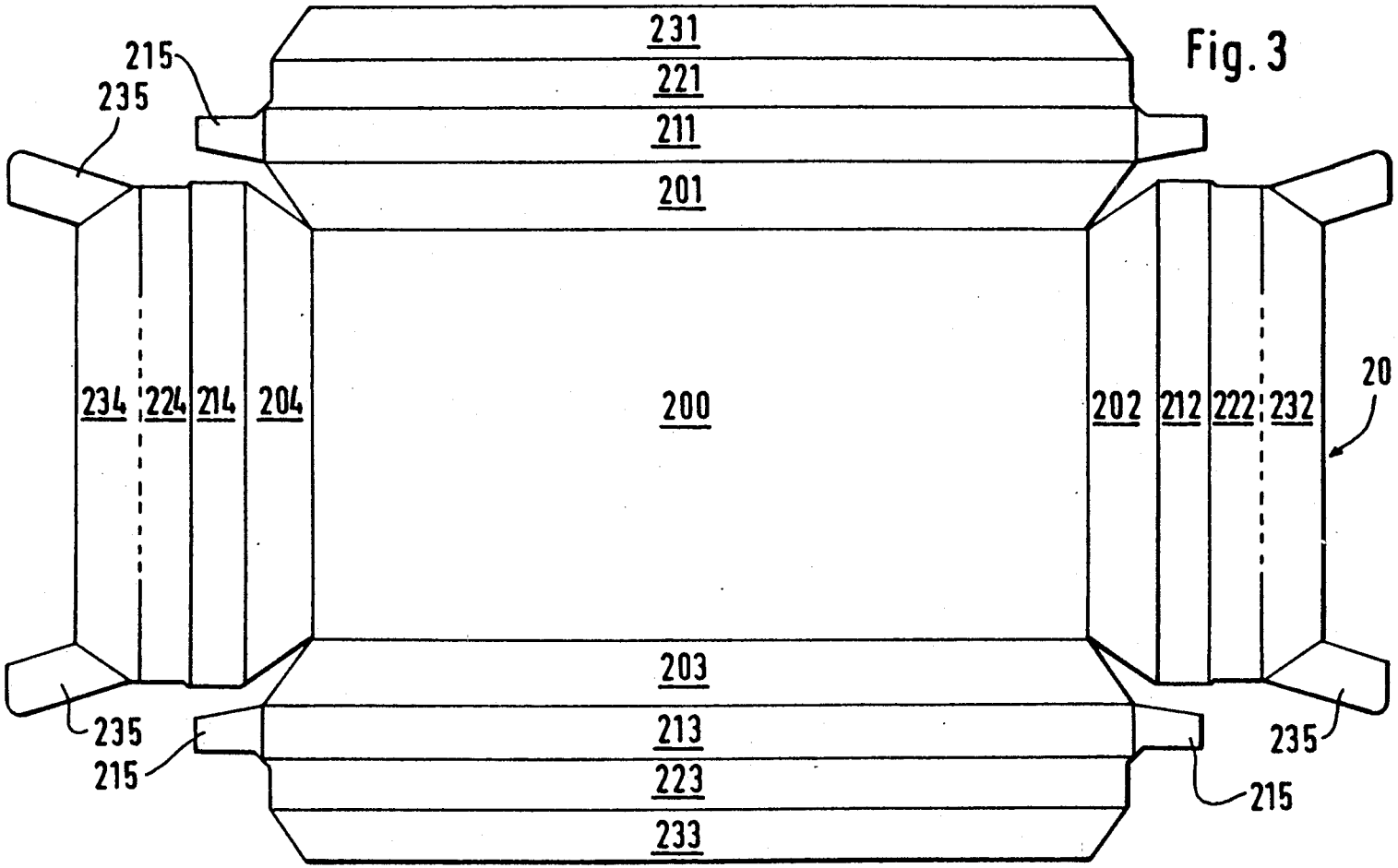
FIG. 3 shows the unfolded lid portion of the packaging.

The packaging shown in FIG. 1 is of a rectangular shape and is suited for a lid portion according to FIG. 3. However, the packaging may be shaped in the form of regular or irregular polygons.

The packaging comprises essentially a bottom portion 10, a lid portion 20, a product holder 30, and a padding insert 40. The embodiment according to FIG. 1 comprises two units, which consist of the product holder 30 and the padding insert 40 and are on top of each other.

The bottom portion 10 is simply cut from cardboard and has a bottom area 100 with walls 110 which are perpendicular to the bottom area 100 and are interconnected. The walls 110 may consist of one or two layers.

The cut of the lid portion 20 is represented in FIG. 3. FIG. 1 shows the lid portion 20 placed on top of the bottom portion.

The lid portion is a single piece and has a base area 200, to which the sections 201 to 204 are connected. The sections 201 through 204 are shaped to form the slant 230, shown in FIG. 1 and are provided with respectively sloped ends. The side wall sections 211 through 214 are connected to the sections 201 through 204 via scorings. When the lid portion is assembled, the side wall sections 211 through 214 are perpendicular to the base area 200. The edge stiffening sections 221 through 224 are connected to the side wall sections 211 through 214, and may be glued to the side wall sections 211 through 214 or may rest on them producing a stiffening action, when the lid portion is assembled. The stiffening sections 231 through 234 are connected to the edge stiffening sections 221 through 224 and act as a stiffening part for the sections 201 through 204.

The flaps 215 are provided at the free ends of two respective spaced side wall sections, 211 and 213. Upon assembly of the lid portion 20, each flaps 215 is fixed between the intermediate side wall sections, 212 and 214, and the respective edge stiffening section, 222 and 224.

The free edges of the edge stiffening sections, 231 and 234, are formed to match the slant 230. The flaps 235 are connected to the free edges of two respective stiffening sections, 232 and 234. Upon assembly of the lid portion 20, each flap 235 is glued to the inside of the respective intermediate section, 201 and 203. The flaps 215 and 235 seal and stabilize the corner sections of the lid portion 20.

The product carrier 30 is equipped with pockets 31 for the insertion of the individual pieces 13, for example, candies. The packaging level of the product carrier 30 is enclosed by the peripheral edge section 32, the upper edge 33 of which extends past the plane, formed by the round tops of the individual pieces 13. A slant 330 of the product holder 30 is connected to the upper edge 33. The slope of the slant 330 basically matches the slope of the slant 230 of the lid portion 20. In the embodiment according to FIG. 1 the slope of the transition slant 230 is smaller than that of the slant 330. The slant 330 may be equipped with longitudinal grooves in order to improve the stiffness of the slant 330. A wall 331 is formed as an integral part at the slant 330 of the product carrier 30, which encloses the pockets 31 of the product carrier 30. The wall 331 provides a space around the pockets but contacts the surface of the bottom side walls 110 facing inside the packaging. The edge between the slant 330 and the wall 331 is positioned below the free rim 111 of the bottom walls 110, so that the pressure of the slant 330 is safely transferred to the bottom walls 110. When the packaging is assembled, the respective contact area is enclosed, from the outside, by the side wall sections 211 to 214, which are interconnected.

Figure 4:
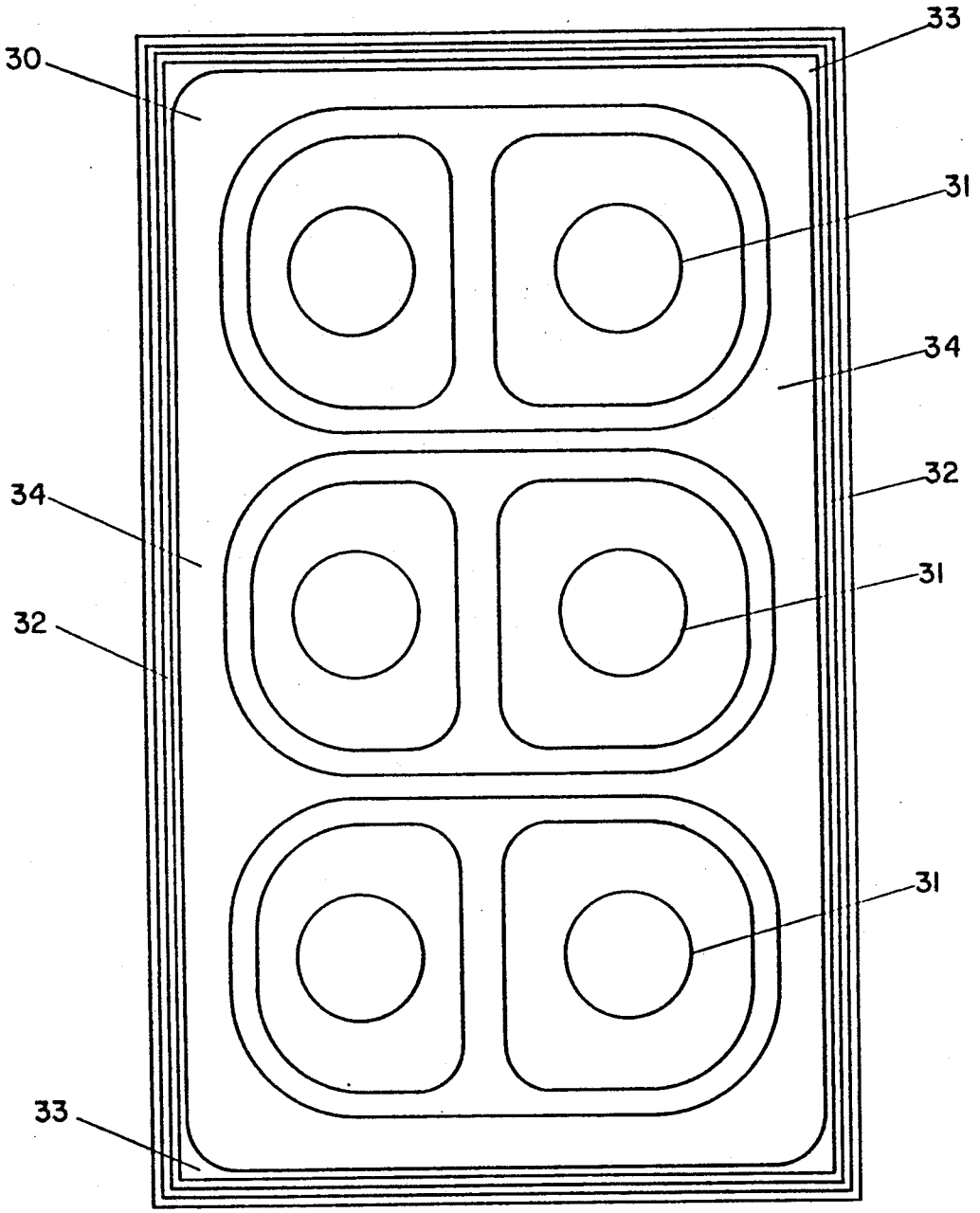
FIG. 4 shows a top view of a packaging with six pockets.

Inside the peripheral edge section 32, the product holder 30 is equipped with supports 34 for the padding inserts 40 (FIG. 4). The supports 34 may be formed as bracket plates and arranged in the corners of the product carrier 30. The supports 34 for the padding inserts 40 are arranged between the plane, which is formed by the round tops of the individual pieces 13, and the plane enclosed by the upper edge 33 of the product holder 30, whereby the upper edge 33 of the peripheral edge section 32 extends past the plane formed by the round tops of the individual pieces 13. The padding insert 40 is supported against lateral movement by the edge section 32 of the product carrier 30. The supports 34 may also be arranged with a distance from the plane, which is enclosed by the upper edge 33, whereby the distance is smaller than the thickness of the padding insert. The base area 200 of the lid portion 20 is then well protected against pressure or impact, since the padding insert 40, which has a stable build, may be inserted under tension into the peripheral edge section, which is preferably formed in a continuous fashion. The distance of the supports, respectively the bracket plates, 34 to the plane, which is enclosed by the upper edge 33, may not be larger than the thickness of the padding insert 40.

The free edge 33 of the product carrier 30 is suitably flattened, so that the base area 200 of the lid portion 20 is additionally stabilized and secured in its position in the area of its edges.

The present invention is, of course, in no way restricted to the specific disclosure of the specification, examples and drawings, but also encompasses any modifications within the scope of the appended claims.

What we claim is:

1. A packaging for food having a product holder, inserted into a bottom portion, and a lid portion which seals the bottom portion containing the product holder; said packaging further comprising:

a peripheral edge section provided on said product holder and extending therefrom downwardly past a free rim of said bottom portion, which edge section has a downward slant toward said bottom portion, said edge section supporting said lid portion.

2. A packaging according to claim 1, in which said lid portion has a transition slant that matches a slope of said slant of said product holder.

3. A packaging according to claim 2, in which said lid portion has a base area, which base area is connected to sections, which sections have respectively slanted ends for the formation of said transition slant and are connected to side wall sections, which side wall sections are perpendicular to said base area upon the assembly of said lid portion.

4. A packaging according to claim 3, in which edge stiffening sections are disposed at said side wall sections, and stiffening section are disposed at said edge stiffening sections.

5. A packaging according to claim 4, in which flaps are provided at free ends of two opposing ones of said side wall sections and, which flaps, in order to assemble said lid portion, are fixed between those side wall sections and those respective edge stiffening sections disposed between said opposing ones of said side wall sections.

6. A packaging according to claim 4, in which free edges of said stiffening sections are formed to match said transition slant and flaps are provided at free edges of two opposing ones of said stiffening sections, which flaps are glued to the inside of those sections, having said transition slant and being disposed between said opposing ones of said stiffening sections.

7. A packaging according to claim 1, in which an upper edge of said peripheral edge section extends past a plane formed by round tops of individual pieces; and between said plane and a plane enclosed by said upper edge of said product holder, supports are provided for a padding insert which padding insert is secured against lateral movement by said edge section of said product holder.

8. A packaging according to claim 7 in which said supports are formed as bracket surfaces in corners of said product holder.

9. A packaging according to claim 8, in which said bracket surfaces are spaced from said plane, formed by said upper edge, by a distance which is at most as wide as the thickness of said padding insert.

10. A packaging according to claim 1, in which said peripheral edge section of said product holder is continuous.

11. A packaging according to claim 7, in which said upper edge of said product holder is flattened.

12. A packaging according to claim 1, in which said slant of said product holder is provided with a wall which wall encloses and is spaced from pockets of the product holder and rests on inner surfaces of bottom walls of said bottom portion.

13. A packaging according to claim 12, in which at least two of said product holders, each equipped with a padding insert, are stacked on top of each other, whereby said slant of that product holder, which is adjacent to said lid portion, extends past said free rim of said bottom walls.

* * * * *